US008702216B2

(12) United States Patent
Stephens et al.

(10) Patent No.: US 8,702,216 B2
(45) Date of Patent: Apr. 22, 2014

(54) POLYMER INTERNAL CONTAMINATION FILTER FOR INK JET PRINTHEAD

(75) Inventors: Terrance L Stephens, Molalla, OR (US); James D. Padgett, Lake Oswego, OR (US); John R. Andrews, Fairport, NY (US); Andrew W. Hays, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 20 days.

(21) Appl. No.: 13/333,068

(22) Filed: Dec. 21, 2011

(65) Prior Publication Data

US 2013/0162737 A1 Jun. 27, 2013

(51) Int. Cl.
*B41J 2/175* (2006.01)

(52) U.S. Cl.
USPC ..... 347/93

(58) Field of Classification Search
USPC ..... 347/20, 65, 66, 85, 86, 87, 93, 92
See application file for complete search history.

(56) References Cited

U.S. PATENT DOCUMENTS

| | | | | |
|---|---|---|---|---|
| 4,864,329 | A * | 9/1989 | Kneezel et al. | 347/93 |
| 5,489,930 | A * | 2/1996 | Anderson | 347/71 |
| 6,139,674 | A * | 10/2000 | Markham et al. | 156/252 |
| 6,168,910 | B1 * | 1/2001 | Hino et al. | 430/328 |
| 6,951,383 | B2 * | 10/2005 | Giere et al. | 347/56 |
| 7,766,463 | B2 | 8/2010 | Stephens et al. | |
| 8,062,836 | B2 * | 11/2011 | Kim et al. | 430/321 |
| 2009/0009575 | A1 * | 1/2009 | Tonami et al. | 347/93 |
| 2011/0141204 | A1 | 6/2011 | Dolan et al. | |
| 2011/0148994 | A1 | 6/2011 | Lin et al. | |
| 2011/0261126 | A1 * | 10/2011 | Faisst et al. | 347/93 |

* cited by examiner

*Primary Examiner* — Anh T. N. Vo
(74) *Attorney, Agent, or Firm* — MH2 Technology Law Group LLP

(57) ABSTRACT

A printhead for printing ink includes a particulate filter manufactured from a polymer sheet such as a polyimide sheet. Filter openings within the particulate filter can be formed using a mask and a laser beam to ablate exposed portions of the polymer sheet. Embodiments of the present teachings can result in the formation smaller filter openings at a smaller pitch within the polymer sheet than, for example, stainless steel particulate filters, and thus more openings which cover a larger percentage of the filter surface for a given filter size, which can result in a reduction of fluid pressure within the printhead. Thus smaller filter openings for improved filtering of smaller particulates can be formed while maintaining a sufficient ink flow at a sufficiently low pressure within the printhead during operation.

17 Claims, 6 Drawing Sheets

POLYMER INTERNAL CONTAMINATION FILTER FOR INK JET PRINTHEAD

FIELD OF THE EMBODIMENTS

The present teachings relate to the field of printing devices, and more particularly to ink jet printing devices including ink jet printheads.

BACKGROUND OF THE EMBODIMENTS

Printing an image onto a print medium such as paper for consumer and industrial use is dominated generally by laser technology and ink jet technology. Ink jet technology has become more common as ink jet printing resolution and print quality has increased. Ink jet printers typically use either thermal ink jet technology or piezoelectric technology. Even though they are more expensive to manufacture than thermal ink jets, piezoelectric ink jets are generally favored as they can use a wider variety of inks and eliminate problems with kogation.

Piezoelectric ink jet printheads typically include a flexible diaphragm manufactured from, for example, stainless steel. Piezoelectric ink jet printheads can also include an array of piezoelectric transducers (i.e., actuators) attached to the diaphragm. Other printhead structures can include one or more laser-patterned dielectric standoff layers and a flexible printed circuit (flex circuit) or printed circuit board (PCB) electrically coupled with each transducer. A printhead can further include a body plate, an inlet/outlet plate, and an aperture plate, each of which can be manufactured from stainless steel. The aperture plate includes a plurality of nozzles (i.e., one or more openings, apertures, or jets) through which ink is dispensed during printing. The number of nozzles per unit area generally determines the printer resolution, with higher resolution devices having more apertures within a given area. As printer resolution increases, the size of the nozzles and the quantity of ink in each ink drop dispensed onto a print medium decreases.

During use of a piezoelectric printhead, a voltage is applied to a piezoelectric transducer, typically through electrical connection with a flex circuit electrode electrically coupled to a voltage source, which causes the piezoelectric transducer to bend or deflect, resulting in a flexing of the diaphragm. Diaphragm flexing by the piezoelectric transducer increases pressure within an ink chamber and expels a quantity of ink from the chamber through a particular nozzle in the aperture plate. As the diaphragm returns to its relaxed (unflexed) position, it reduces pressure within the chamber and draws ink into the chamber from a main ink reservoir through an opening to replace the expelled ink.

During printhead manufacture, contaminants can be introduced into the printhead. These contaminants can be transported to the nozzle during printing where they can block the flow of ink through the nozzle and reduce print quality. To filter contaminants in the printhead a stainless steel particulate filter or "rock screen" can be used.

Printhead structures which can improve print quality and reduce printhead costs would be desirable.

SUMMARY OF THE EMBODIMENTS

The following presents a simplified summary in order to provide a basic understanding of some aspects of one or more embodiments of the present teachings. This summary is not an extensive overview, nor is it intended to identify key or critical elements of the present teachings nor to delineate the scope of the disclosure. Rather, its primary purpose is merely to present one or more concepts in simplified form as a prelude to the detailed description presented later.

In an embodiment of the present teachings, a method for forming an ink jet printhead particulate filter can include aligning a polymer sheet with a patterned mask, wherein the patterned mask comprises a plurality of openings which expose first portions of the polymer sheet and an opaque layer which covers second portions of the polymer sheet, and removing the exposed first portions of the polymer sheet to form a plurality of filter openings through the polymer sheet.

In another embodiment, a method of forming an ink jet printhead can include forming an ink jet printhead particulate filter using a method which includes aligning a polymer sheet with a patterned mask, wherein the patterned mask includes a plurality of openings therein which expose first portions of the polymer sheet and a body which covers second portions of the polymer sheet and removing the exposed first portions of the polymer sheet to form a plurality of filter openings through the polymer sheet. The method can further include positioning the ink jet printhead particulate filter into an ink path at a location sufficient to filter ink during operation of the printhead.

In another embodiment, an ink jet printhead particulate filter can include a polymer sheet having a plurality of filter openings therein, wherein each of the plurality of filter openings has a width or diameter of between about 5 μm and about 30 μm and a pitch of between about 15 μm and about 40 μm.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. have been simplified and are drawn to facilitate understanding of the present teachings rather than to maintain strict structural accuracy, detail, and scale.

DESCRIPTION OF THE EMBODIMENTS

Reference will now be made in detail to exemplary embodiments of the present teachings, examples of which are illustrated in the accompanying drawings. Wherever possible, the same reference numbers will be used throughout the drawings to refer to the same or like parts.

As used herein unless otherwise specified, the word "printer" encompasses any apparatus that performs a print outputting function for any purpose, such as a digital copier, a bookmaking machine, a facsimile machine, a multi-function machine, a plotter, etc. Unless otherwise specified, the word "polymer" encompasses any one of a broad range of carbon-based compounds formed from long-chain molecules including thermoset polyimides, thermoplastics, resins, polycarbonates, epoxies, and related compounds known to the art.

With increasing ink jet printhead resolution and decreasing nozzle diameter, the manufacture of high-resolution ink jet printheads has included the use of stainless steel particulate filters, also referred to as "rock screens," to filter contaminants from the ink during printing. Openings through the particulate filter must be sufficiently small to ensure filtration of contaminants which are large enough to block or plug the nozzle. Efficient filtration is essential, for example because a high-end printhead can be extremely expensive. A 40 μm particle can block a nozzle to result in a malfunctioning printhead which requires replacement. Warranty costs for contamination failures can be high and premature failure of an expensive part can be damaging to brand loyalty. Manufacturing printheads in a cleanroom environment similar to an integrated circuit (IC) manufacturing cleanroom may reduce contamination such that a rock screen would not be necessary, but cleanroom manufacture would be prohibitively expensive, for example because printhead production quantities are far below IC production quantities and cost per unit of IC cleanroom manufacture would be much higher.

Figure 9:
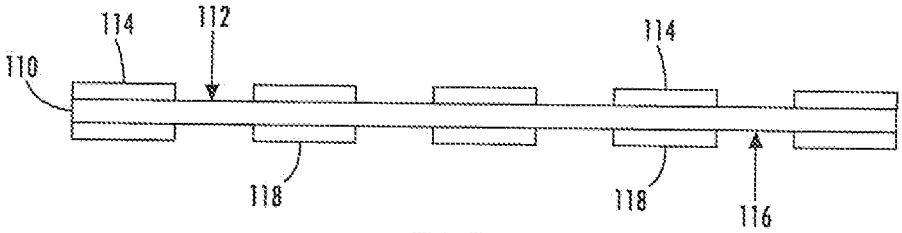
FIG. 9 (RELATED ART)
FIGS. 9 and 10 are cross sections depicting formation of a printhead particulate filter using another technique.
Figure 10:
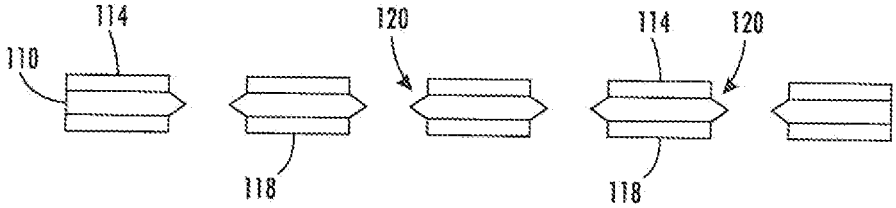
FIG. 10 (RELATED ART)

As discussed above, the size of the nozzle decreases as print resolution increases. Further, as the size of the nozzle decreases the size of the rock screen openings must also decrease to filter out smaller particles which could block the smaller nozzles. One problem with decreasing the size of the particulate filter openings is that the flow of ink through the filter is constricted, which decreases delivery flow of the ink to the nozzle and increases pressures within the printhead. In a typical macroscopic scale filter for various other technologies, the number of openings can often be increased when the size of the openings is decreased so that a suitable flow of material through the filter can be maintained. However, rock screens for printheads are conventionally formed at a microscopic scale using an acid etch (wet etch) and a pair of masks, with one mask on each side of a stainless steel plate as depicted in FIGS. 9 and 10. In FIG. 9, a stainless steel plate 110 is masked on a first side 112 with a first photoresist mask 114 and on a second side 116 with a second photoresist mask 118. The stainless steel plate 110 and the two photoresist masks 114, 118 must be assembled so that the openings through the masks 114, 118 are vertically aligned. After forming the FIG. 9 structure, the assembly is placed into an acid bath to etch the stainless steel plate 112 from both sides, which results in the FIG. 10 structure. The acid etch through the thickness of the stainless steel plate can result in stainless steel points, projections, or "bird's beaks" 120 which extend past the edges of the mask as depicted in FIG. 10. These projections have an acceptable effect on filter opening pitch when forming rock screens with larger openings, but as nozzle diameters continue to decrease the area of the projections will be a larger percentage of the area of the particulate filter openings. In other words, the size of each projection will be the same regardless of hole diameter. The smallest possible opening pitch for a stainless steel rock screen is limited, for example, to about 59.8 μm. Additionally, the chemical etching of small openings is imprecise and can result in filter openings with a large statistical distribution around a target diameter. For example, a stainless steel rock screen with a target opening diameter of 30 μm can have a sigma of about 1.85 μm and an average (mean) size of about 29.4 μm. The average opening size is smaller than the target size due to, for example, the projections 120 as depicted in FIG. 10. It will become increasingly difficult to form a sufficient number of small openings, particularly openings less than or equal to 30 μm, so that pressures within the printhead can be maintained at a sufficient level while filtering out particles which might block the small nozzles. Further, contamination is not necessarily spherical and may have a large aspect ratio, and thus the particulate filter is most effective when the diameter of the filter openings is targeted to be much smaller than the nozzle diameter.

An embodiment of the present teachings can include a particulate filter (rock screen) for an ink jet printhead such as a solid ink printhead manufactured from a material which can be etched using nonchemical techniques, such as through the use of a laser. The present teachings can also include a printhead and a printer having the particulate filter as described.

An embodiment of the present teachings can include the use of a polymer material such as a polyimide film or sheet. In an embodiment, a polyimide film can have a thickness of between about 6 μm and about 125 μm, or between about 6 μm and about 50 μm, or between about 12 μm and about 25 μm, for example about 25 μm thick.

Figure 1:
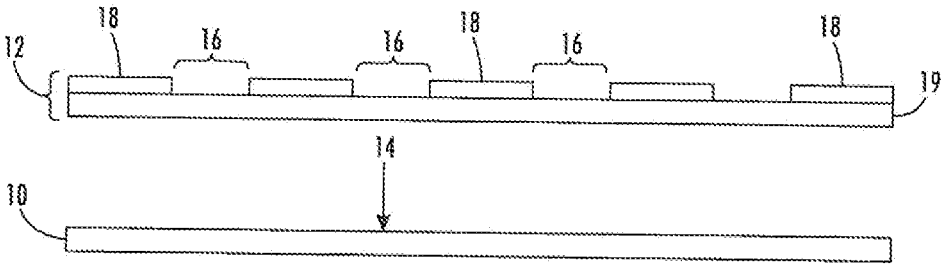
FIG. 1 is a cross section.
Figure 2:
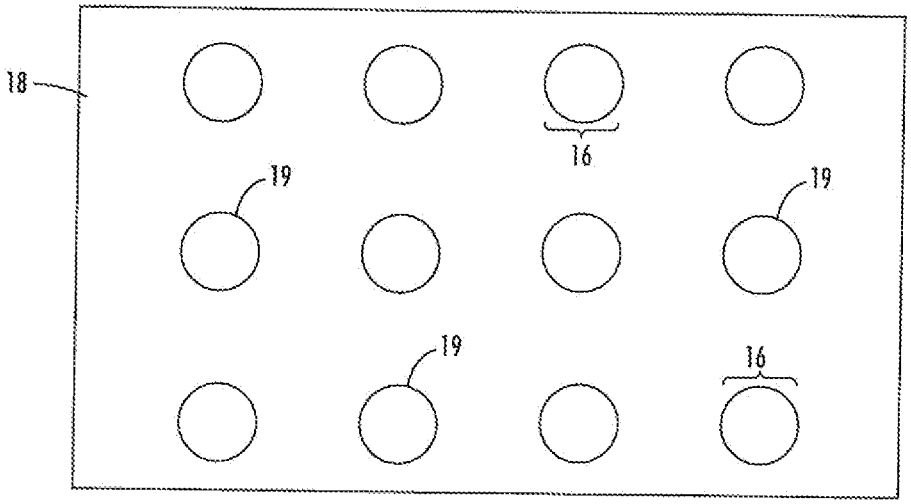
FIG. 2 is a plan view of FIG. 1, of an in-process structure to form a polymer particulate filter.

FIG. 1 is a schematic cross section, and FIG. 2 is a schematic plan view, depicting a polymer sheet 10 such as a polyimide sheet aligned with a patterned mask or reticle 12 (referred to collectively hereinafter as "mask") positioned above a surface 14 of the polymer sheet 10. A polyimide polymer sheet 10 can include, for example, DuPont™ Kapton® polyimide or a Upilex® polyimide available from Ube Industries. The mask 12 can include an arrangement of openings 16 within an opaque layer 18 such as chrome on a transparent quartz plate 19. In another embodiment, the mask 12 can be a single layer of metal having openings therethrough. The openings 16 expose first portions the polymer sheet 10, while the opaque layer 18 of the quartz mask 12 or the body of the metal mask covers and protects second portions of the polymer sheet 10. While FIGS. 1 and 2 depict the mask 12 the same size as the polymer sheet 10 for simplicity, it will be understood that the mask 12 can be a different scale, for example using a photolithographic lens system such as that described below with regard to FIG. 3. Further, FIG. 2 depicts 12 openings for simplicity, but it will be understood that a rock screen according to the present teachings can have hundreds or thousands of openings, and thus FIG. 2 depicts only part of a complete structure.

Figure 3:
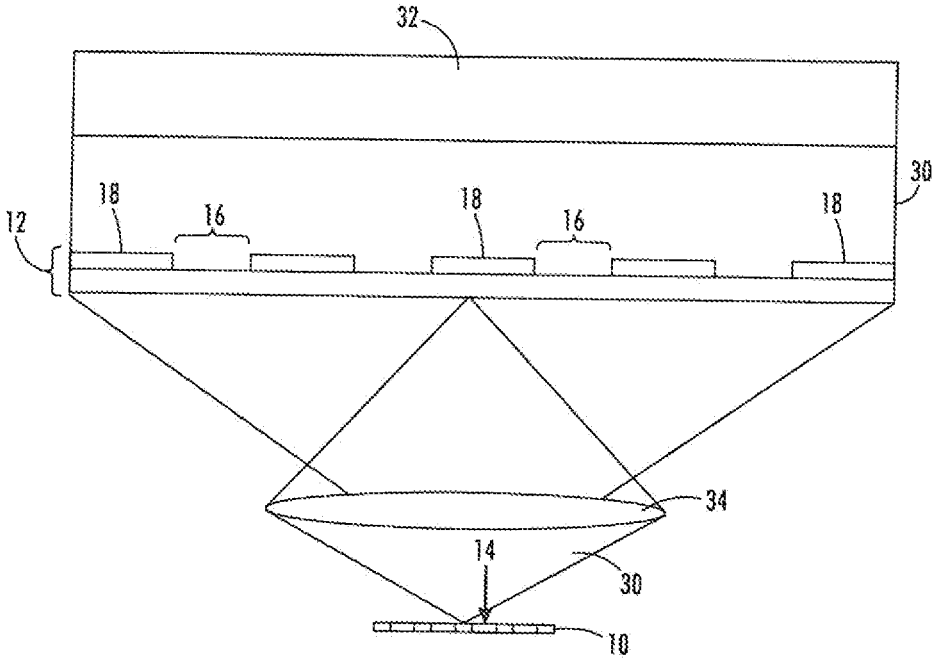
FIG. 3 is a cross section of a polymer layer and a lens system during laser ablation of the polymer sheet to form a particulate filter from the polymer sheet.
Figure 4:
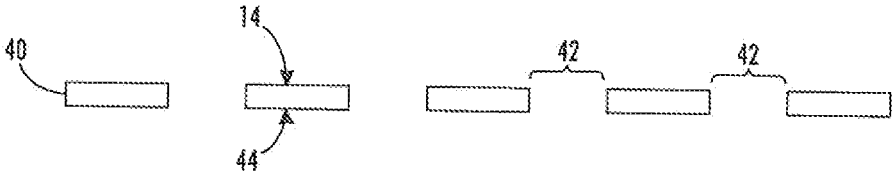
FIG. 4 is a cross section depicting a portion of the polymer sheet after laser ablation is complete.

After forming a structure similar to FIGS. 1 and 2, a laser beam 30 output by a laser 32 can be directed through the openings 16 in the mask 12 and onto the exposed portions of the upper surface 14 of the polymer sheet 10 as depicted in the schematic cross section of FIG. 3 to heat and ablate the portions of the polymer sheet 10 which are exposed by the openings 16 in the mask 12. The FIG. 3 structure can include a lens 34 as part of a photolithographic system which focuses the laser beam 30 as depicted. In an embodiment, the lens 34 can provide a scaled reduction of feature sizes, for example a five times reduction such that the diameter of the openings 16 in the mask 12 can be five times the diameter of the openings formed in the polymer layer 10. While FIG. 3 depicts laser ablation to form openings for a single particulate filter, it will be understood that a plurality of particulate filters can be formed at several different locations within a single polymer sheet 10. For a polyimide polymer sheet 10 having a thickness of about 25 μm, a krypton fluoride (KrF) laser outputting a wavelength of 248 nanometers or a xenon chloride (XeCl)

laser outputting a wavelength of 308 nanometers, as well as other lasers at other wavelengths, can be used. The laser beam 30 can be pulsed onto the exposed portions of the polymer sheet 10 for a duration or pulse count sufficient to ablate through the thickness of the exposed polyimide to provide a polymer sheet 40 having openings 42 therethrough similar to that depicted in FIG. 4.

In an embodiment, the openings 42 which result from the formation by laser 32 can have a tapered shape. The opening diameter can be smaller at a point further away from the laser 32. That is, each opening 42 at the front surface 14 of the polymer layer 40 will be larger than the opening 42 at the back surface 44 of the polymer layer 40. The opening 42 at surface 14 can be referred to as an "entrance opening" and the opening at surface 44 can be referred to as an "exit opening" as the laser 32 ablates the thickness of the polymer 10 from the front 14 to the back 44. In an embodiment using a 25 μm thick polymer layer 40, each entrance opening at surface 14 can be about 6 μm larger than each exit opening at surface 44. A pitch of the entrance openings can be targeted to be equal to a target diameter of each opening 42 plus about 10 μm. For an exit opening targeted for 15 μm, the entrance opening can be about 21 μm and thus the pitch of the entrance openings can be targeted at about 31 μm. In a lens system which has a 5× demagnification, the openings 16 in the mask 12 for this specific embodiment can have a diameter of 5×21 μm (i.e., 105 μm) and the pitch can be 5×31 μm (i.e., 155 μm). In an embodiment, the exit openings can be targeted for a diameter of between about 1 μm to about 40 μm, or between about 5 μm and about 30 μm, or about 10 μm to about 15 μm. In the present embodiment, the polymer sheet 40 including the particulate filter can appear in plan view similar to the FIG. 2 depiction.

Figure 5:
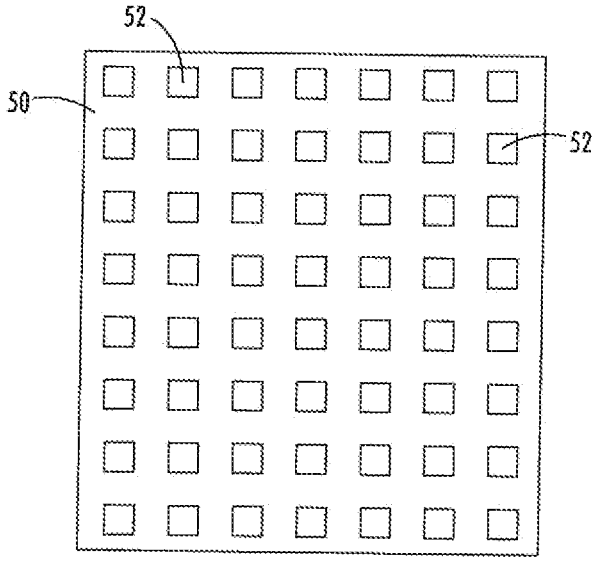
FIGS. 5 and 6 are plan views depicting portions of two different polymer sheets for use as particulate filters for ink jet printheads.

Conventional stainless steel rock screens are generally limited to circular openings because a wet etch is poor at removing metal from tight corners of square openings using a contact mask having square openings. While the FIG. 2 mask 12 can be used to form a particulate filter 40 having circular openings which are aligned in a grid as depicted, other rock screen designs are contemplated. For example, FIG. 5 depicts a rock screen 50 having square openings 52, with each opening 52 vertically and horizontally aligned with adjacent openings to form a grid. The FIG. 5 structure include a 7×8 grid of square openings, but it will be understood that a rock screen 50 may have hundreds or thousands of openings 52.

Square openings may be preferred over round openings in some uses, as a pattern of square openings has more surface area devoted to filter openings, thus improving the flow of ink through the filter. In other words, for a given filter size and number of openings, fluidic resistance through a filter which uses round openings is higher than a filter which uses square openings because the total area of the square openings is greater than the total area of the round openings. Equating the diameter of a round hole with a height/width of a square hole, the square hole yields about 33% more space than a round hole. Other shaped openings are also contemplated, for example rectangular and star shaped, as well as other polygonal shapes.

Figure 6:
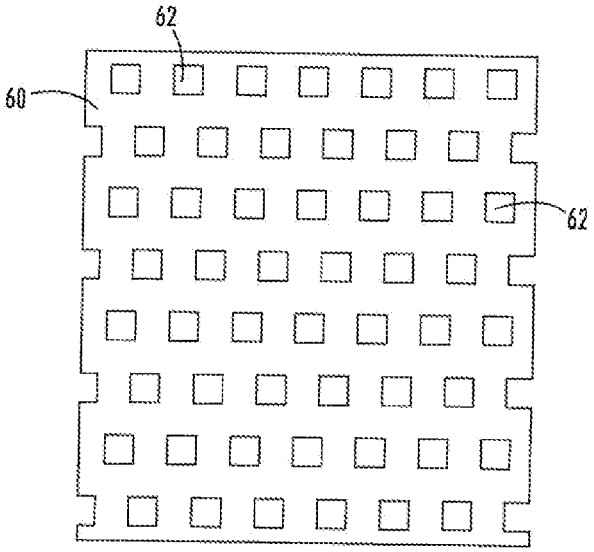

FIG. 6 depicts a rock screen 60 having square openings 62 arranged in a plurality of rows and columns, with each row of openings 62 horizontally offset with the rows immediately above and below to form an offset rock screen. The FIG. 6 structure depicts a total of 52 openings 62, but it will be understood that a rock screen 60 may have hundreds or thousands of openings 62. The alternating pattern of openings 62 as depicted in FIG. 6 may result in a particulate filter with improved web strength compared to a particulate filter in which the openings are arranged in a grid, for example as depicted in FIG. 5. Normal jetting and purge operations impart a hydrostatic pressure gradient across the rock screen, for example because of viscous losses. The hydrostatic pressure results in tensile stress in the rock screen web. It has been found that the alternating opening orientation to form an offset rock screen as depicted in FIG. 6 may result in lower stress than the aligned grid orientation of FIG. 5, for example.

A polymer particulate filter etched using laser ablation can have a smaller hole-to-hole pitch compared to a stainless steel particulate filter patterned with a contact mask and a wet etch. For example, a stainless steel particulate filter is limited to a minimum hole pitch of about 60 μm, for example about 59.8 μm, while a polyimide particulate filter can have a hole pitch of between about 10 μm to about 30 μm or less, for example about 12 μm. Further, it has been found that while a stainless steel rock screen can be etched to form a circular opening diameter of about 30 μm, a polymer rock screen can have a square opening with a width of just a few micrometers, for example between about 1 μm to about 40 μm, or between about 5 μm and about 30 μm, or about 10 μm to about 15 μm. In an embodiment; a polymer particulate filter can have a square or circular opening size of about 15 μm, and a pitch of between about 25 μm and about 30 μm. Further, the formation of openings in a polymer sheet can be more precise. A plurality of square openings targeted for a width 14 μm can have a completed mean width of about 14.2 μm and a sigma of about 0.27 μm.

In addition to the functional improvements described herein, a polymer rock screen can have a reduced cost compared to a stainless steel rock screen. Further, the formation process can be less environmentally damaging than a metal etching process. The formation of a stainless steel rock screen requires the use of strong metal-etching acids during a chemical etch. Using metal-etching acids can require a relatively longer etch time, and the resulting post-etch solution can have high disposal costs. A laser-drilled polymer filter has reduced byproducts which can generally comprise carbon, nitrogen, and oxygen compounds, and a high manufacturing throughput, and therefore a reduced cost of manufacture compared to a wet etched stainless steel rock screen layer.

Conventional rock screens have required specific placement within the printhead so that internal pressures are within acceptable levels. As nozzle diameters decrease, the flow of ink through a stainless steel particulate filter will be restricted due to the large pitch and reduced size of openings through the filter. Placing a stainless steel filter at a more upstream location relative to the flow of ink through the printhead would allow for a greater filter surface area and thus more openings, resulting in a reduction of printhead pressures. However, structures within the ink path which are located downstream of the filter must be manufactured and assembled under clean conditions, as any particulates that are introduced during manufacture at a location downstream of the rock screen is not filtered and any particulates located downstream of the particulate filter can enter the nozzle.

An embodiment of the present teachings can include a rock screen which services (i.e., filters ink for only) a single nozzle rather than having to service a plurality of nozzles. Because the fluidic resistance of the particulate filter of the present teachings is less than a conventional particulate filter, a smaller filter can be used and placed at an improved location within the printhead which is further downstream relative to the flow of ink through the printhead compared to a stainless steel particulate filter.

Figure 7:
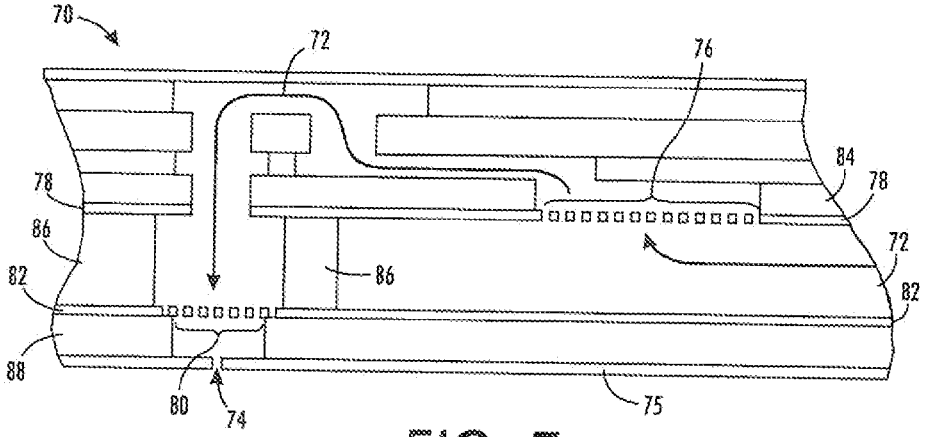
FIG. 7 is a composite cross section depicting two filters at two possible locations within a printhead according to embodiments of the present teachings.

FIG. 7 depicts a portion of a printhead 70 and an ink path 72 through the printhead 70. The ink path terminates at the nozzle 74 within an aperture plate 75, where ink is ejected onto a print medium (not depicted for simplicity). FIG. 7 depicts two different particulate filters positioned in the ink path, with a first filter 76 formed from a first compliant polymer pad 78 and a second filter 80 formed from a second compliant polymer pad 82. The first filter 76 is positioned at a first printhead location and the second filter 80 is positioned at a second printhead location. It will be understood that the fluid path of FIG. 7 can include either filter 76 or filter 80, but not typically both. However, multiple particulate filters within an ink path are also contemplated and within the scope of the present teachings. The location of the ink jet printhead particulate filter within the ink path is sufficient to filter ink during operation of the printhead.

It will be appreciated that the filters 76, 80 each service only one nozzle 74. That is, each nozzle 74 of the printhead includes a filter associated only with that nozzle 74. It will be understood that each compliant pad 78, 80 may have a plurality of filters formed therein for a plurality of different nozzles, but that each filter 76, 80 within each pad of these embodiments services only a single nozzle 74.

In an embodiment, the compliant pad 78 is positioned below a vertical inlet layer 84 and above a separator layer 86, such that compliant pad 78 is interposed between structures 84, 86. In another embodiment, compliant pad 82 is positioned below the separator layer 86 and above an inlet/outlet plate 88, such that compliant pad 82 is interposed between the structures 86, 88. Each of these structures 84, 86, 88 can be stainless steel or another suitable material.

Figure 8:
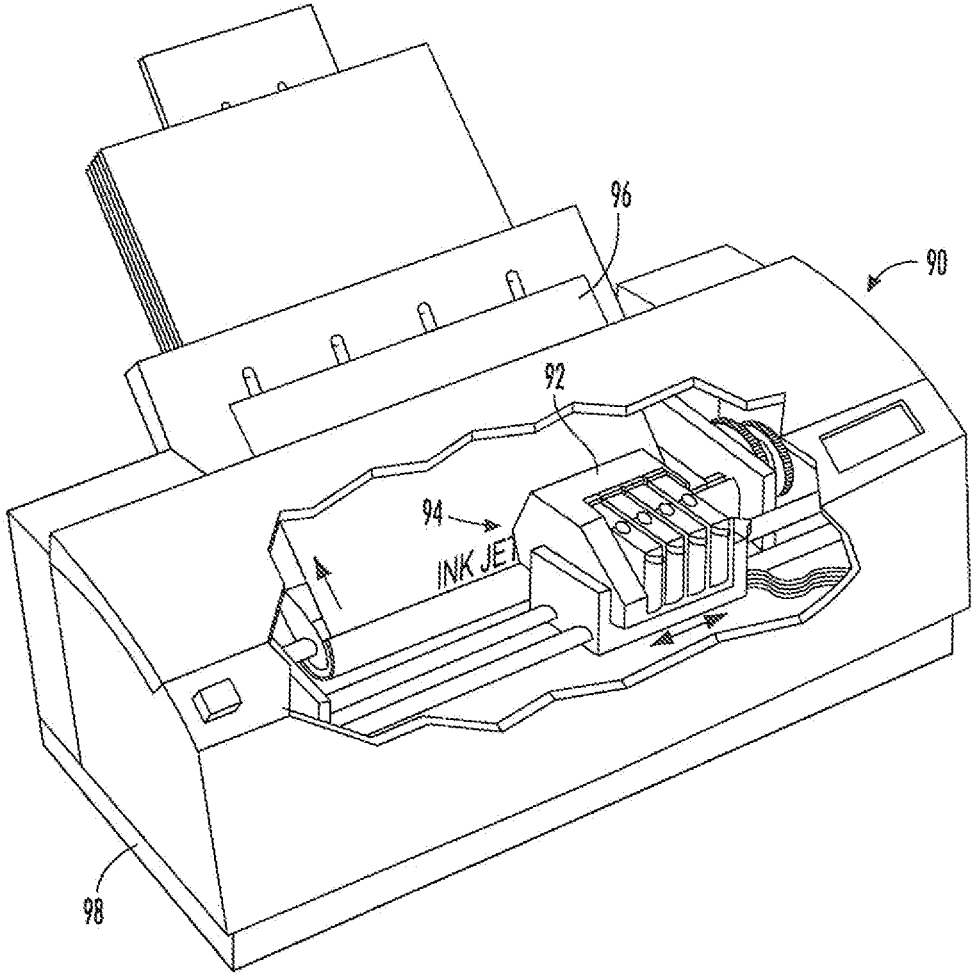
FIG. 8 is a perspective depiction of a printer according to an embodiment of the present teachings.

Once manufacture of the printhead structures is complete, one or more printheads 70 can be installed in a printer. FIG. 8 depicts a printer 90 including one or more printheads 92 and ink 94 being ejected from one or more nozzles 74 in accordance with an embodiment of the present teachings. Each printhead 92 is configured to operate in accordance with digital instructions to create a desired image on a print medium 96 such as a paper sheet, plastic, etc. Each printhead 92 may move back and forth relative to the print medium 96 in a scanning motion to generate the printed image swath by swath. Alternately, the printhead 92 may be held fixed and the print medium 96 moved relative to it, creating an image as wide as the printhead 92 in a single pass. The printhead 92 can be narrower than, or as wide as, the print medium 96. The printer hardware including the printhead 92 can be enclosed in a printer housing 98. In another embodiment, the printhead 92 can print to an intermediate surface such as a rotating drum or belt (not depicted for simplicity) for subsequent transfer to a print medium.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. A method for forming an ink jet printhead particulate filter, comprising:

aligning a polymer sheet with a patterned mask, wherein the patterned mask comprises a plurality of openings which expose first portions of the polymer sheet and an opaque layer which covers second portions of the polymer sheet;

removing the exposed first portions of the polymer sheet by directing a laser beam through each of the plurality of openings within the patterned mask and onto the polymer sheet to ablate the exposed first portions of the polymer sheet to form a plurality of filters each comprising a plurality of filter openings through the polymer sheet, wherein the removal of the exposed first portions of the polymer sheet configures the plurality of filters to service a plurality of printhead nozzles within a printhead and further configures each filter of the plurality of filters to service only one printhead nozzle within the printhead.

2. The method of claim 1, further comprising forming filter openings having a width or diameter of between about 5 μm and about 30 μm during the direction of the laser beam onto the polymer sheet.

3. The method of claim 2, further comprising forming filter openings having a pitch of between about 15 μm and about 40 μm during the direction of the laser beam onto the polymer sheet.

4. The method of claim 1, further comprising forming filter openings having a width or diameter of about 15 μm and a pitch of about 25 μm during the direction of the laser beam onto the polymer sheet.

5. The method of claim 1, further comprising aligning a polyimide sheet having a thickness of between about 6 μm and about 125 μm during the alignment of the polymer sheet with the patterned mask.

6. The method of claim 5, further comprising aligning the polyimide sheet with a quartz mask during the alignment of the polymer sheet with the patterned mask.

7. The method of claim 1, further comprising forming a plurality of square holes during the removal of the exposed first portions of the polymer sheet.

8. The method of claim 7, further comprising forming a plurality of square holes in a plurality of rows and columns during the removal of the exposed first portions of the polymer sheet, wherein each row of square holes is horizontally offset with rows immediately above and below to form an offset particulate filter.

9. A method of forming an ink jet printhead, comprising:

forming an ink jet printhead particulate filter using a method comprising:

aligning a polymer sheet with a patterned mask, wherein the patterned mask comprises a plurality of openings therein which expose first portions of the polymer sheet and a body which covers second portions of the polymer sheet;

removing the exposed first portions of the polymer sheet by directing a laser beam through each of the plurality of openings within the patterned mask and onto the polymer sheet to ablate the exposed first portions of the polymer sheet to form a plurality of filters each comprising a plurality of filter openings through the polymer sheet;

positioning the polymer sheet comprising the plurality of filters and the plurality of filter openings between a vertical inlet and an inlet/outlet plate; and attaching a nozzle plate comprising a plurality of nozzles to the inlet/outlet plate, wherein the plurality of filters of the polymer sheet are configured to service a plurality of nozzles within the nozzle plate and each filter of the plurality of filters services only one nozzle within the nozzle plate.

10. The method of claim 9, further comprising forming filter openings having a width or diameter of between about 5 μm and about 30 μm during the direction of the laser beam onto the polymer sheet.

11. The method of claim 10, further comprising forming filter openings having a pitch of between about 15 μm and about 40 μm during the direction of the laser beam onto the polymer sheet.

12. The method of claim 10, further comprising forming filter openings having a width or diameter of about 15 μm and a pitch of about 25 μm during the direction of the laser beam onto the polymer sheet.

13. The method of claim 10, further comprising aligning a polyimide sheet having a thickness of between about 6 μm and about 125 μm during the alignment of the polymer sheet with the patterned mask.

14. The method of claim 13, further comprising aligning the polyimide sheet with a quartz mask during the alignment of the polymer sheet with the patterned mask.

15. An ink jet printhead particulate filter comprising:

a polymer sheet comprising a plurality of filters therein, each filter comprising a plurality of filter openings therein, wherein the plurality of filter openings are a plurality of square shaped holes and each of the plurality of filter openings has a width of between about 5 μm and about 30 μm and a pitch of between about 15 μm and about 40 μm, wherein the plurality of filters in the polymer sheet are configured to service a plurality of printhead nozzles within a printhead and each filter of the plurality of filters is configured to service only one printhead nozzle within the printhead.

16. The ink jet printhead of claim 15, wherein the plurality of filter openings are arranged in a plurality of rows and columns.

17. The ink jet printhead of claim 16, wherein each row of square shaped holes is horizontally offset with rows of square shaped holes immediately above and below to form an offset particulate filter.

* * * * *